US007670164B2

(12) United States Patent
Shiga

(10) Patent No.: US 7,670,164 B2
(45) Date of Patent: Mar. 2, 2010

(54) WATERPROOF ELECTRICAL CONNECTOR

(75) Inventor: Katsumi Shiga, Chiba (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/392,750

(22) Filed: Feb. 25, 2009

(65) Prior Publication Data

US 2009/0215300 A1 Aug. 27, 2009

(30) Foreign Application Priority Data

Feb. 25, 2008 (JP) ..... 2008-043314

(51) Int. Cl.
*H01R 13/28* (2006.01)

(52) U.S. Cl. ..... 439/278

(58) Field of Classification Search ..... 439/278, 439/277, 320, 587, 589
See application file for complete search history.

(56) References Cited

U.S. PATENT DOCUMENTS 6,699,078 B2 * 3/2004 Quadir ..... 439/693
7,476,128 B2 * 1/2009 Schmitt ..... 439/589
7,481,584 B2 * 1/2009 Cairns ..... 385/60
7,491,081 B2 * 2/2009 Fehling et al. ..... 439/320
2004/0009702 A1 * 1/2004 Potega ..... 439/578
2006/0178049 A1 * 8/2006 Ishikawa ..... 439/587

FOREIGN PATENT DOCUMENTS

JP 06-084565 3/1994
JP 2005-327570 11/2005
JP 2007-258041 10/2007

* cited by examiner

*Primary Examiner*—Jean F Duverne
(74) *Attorney, Agent, or Firm*—Barley Snyder LLC

(57) ABSTRACT

A waterproof electrical connector having a main housing providing a fitting section which is fitted into a contact-receiving concavity of a mating connector and a head section stretching at a rear of the fitting section in a direction in which the fitting section is fitted into the mating connector, a contact that is housed in the fitting section such that one end of the contact is housed in the head section and is connected to one end of an insulated electrical wire which is guided out in a direction perpendicular to the direction in which the fitting section is fitted into the mating connector, a cover housing that covers the head section, and a body that covers at least a boundary portion between the main housing and the cover housing.

12 Claims, 12 Drawing Sheets

WATERPROOF ELECTRICAL CONNECTOR

CROSS-REFERENCE TO RELATED APPLICATIONS

This application claims the benefit of the filing date under 35 U.S.C. § 119(a)-(d) of Japanese patent application document 2008-043314 of Feb. 25, 2008.

FIELD OF THE INVENTION

The present invention relates to an electrical connector that electrically connects an electrical wire to a mating connector, and more particularly relates to a waterproof electrical connector.

BACKGROUND

Conventionally, among electrical connectors, waterproof connectors which prevent water from entering the connecting portion with a mating connector are known. The air bag systems of automobiles send an electrical signal to the ignition device to cause an explosion, and the gas generated from the explosion fills the air bag. The wiring which sends the electrical signal in the air bag system is connected to the mating connector on the ignition device through an electrical connector. Recently, air bag devices have come to be installed not only in the steering portion in the interior of automobiles, but also, inside the doors as a curtain air bag or a side air bag. Since condensation or the like is more likely to be formed inside the doors compared with the interior, the connectors used inside the doors needs to be waterproof. As one of the electrical connectors, there is proposed, for example, a waterproof electrical connector in which an outer side of an insulative housing sandwiching electrical wires guided out is covered with a body by melt molding. Thereby the body is formed integrally with the insulative housing (for example, see Japanese Patent Application Publication No. 2007-258041).

In the waterproof electrical connector proposed in Japanese Patent Application Publication No. 2007-258041, the insulative housing includes a main housing and a cover housing which are both made of insulating synthetic resin. The main housing has an electrical wire housing end section projected in a direction in which an electrical wire projects. A projection is formed on both side surfaces of the electrical wire housing end section. The cover housing covers a section spreading to the rear of the main housing in a direction in which the electrical connector is fitted to the mating connector (hereinafter referred to as a head section), and has an electrical wire covering end section that covers the electrical wire housing end section of the main housing. A lock is provided at both ends of the electrical wire covering end section. The lock prevents the cover housing, which covers the head section, from coming off the head section.

The insulative housing holds the electrical wire connection section of a contact and the electrical wire by sandwiching them with the electrical wire housing end section of the main housing and the electrical wire covering end section of the cover housing.

The body covers a part of the main housing and the entire surface of the cover housing, which includes both a boundary portion between the main housing and the cover housing and portions sandwiching the electrical wire. In other words, an insulating coating of the electrical wire is adhered to the main housing with the body.

Moreover, the cover housing is thinly formed from the request of a reduction in height in the waterproof electrical connector.

In the waterproof electrical connector proposed in Japanese Patent Application Publication No. 2007-258041, the cover housing is thinly formed from the request of a reduction in height in the waterproof electrical connector. The lock, which locks the cover housing, is provided on only both ends of the electrical wire covering end section. Therefore, for example, when the electrical wire is pulled, and force that lifts the electrical wire to the cover housing side acts on the electrical wire, the cover housing is bent. Moreover, when an amount of bending is large, the cover housing may be detached from the main housing. When the cover housing is bent or detached from the cover housing, the body may be peeled off the insulative housing. Then, when the body is peeled, the waterproof electrical connector loses its waterprooffness.

Regarding this problem, the body is prevented from being peeled, for example, by increasing the rigidity of the cover housing, or by increasing an adhesive area to improve an adhesive force. Thereby, the waterproof electrical connector has high waterprooffness. However, such methods prevent a reduction in a height of the waterproof electrical connector and thereby adds to increased size.

SUMMARY

The present invention has been made in view of the above circumstances and provides a waterproof electrical connector having a high waterprooffness without preventing a reduction in height and without increasing its size.

According to the invention, a waterproof electrical connector having a main housing providing a fitting section which is fitted into a contact-receiving concavity of a mating connector and a head section stretching at a rear of the fitting section in a direction in which the fitting section is fitted into the mating connector, a contact that is housed in the fitting section such that one end of the contact is housed in the head section and is connected to one end of an insulated electrical wire which is guided out in a direction perpendicular to the direction in which the fitting section is fitted into the mating connector, a cover housing that covers the head section, and a body that covers at least a boundary portion between the main housing and the cover housing. The head section includes an electrical wire housing end section which projects in the direction in which the electrical wire is guided out, and the cover housing includes an electrical wire covering end section which covers the electrical wire housing end section. The one end of the electrical wire is housed in the electrical wire housing end section and covered by the electrical wire covering end section, the electrical wire is guided out from the electrical wire housing end section, and the electrical wire housing end section includes an electrical wire restraining member that projects from a bottom of the electrical wire housing end section to a side of the cover housing with respect to the one end of the electrical wire housed in the electric wire end housing section and spreads between the one end of the electrical wire and the electrical wire covering end section, and restrains the one end of the electrical wire in the electrical wire housing end section so as to prevent the one end of the electrical wire from being lifted when a force lifting the electrical wire to a side of the cover housing acts on the electrical wire.

DETAILED DESCRIPTION OF THE EMBODIMENT(S)

An embodiment of the present invention will be described with reference to the drawings.

Figure 1:
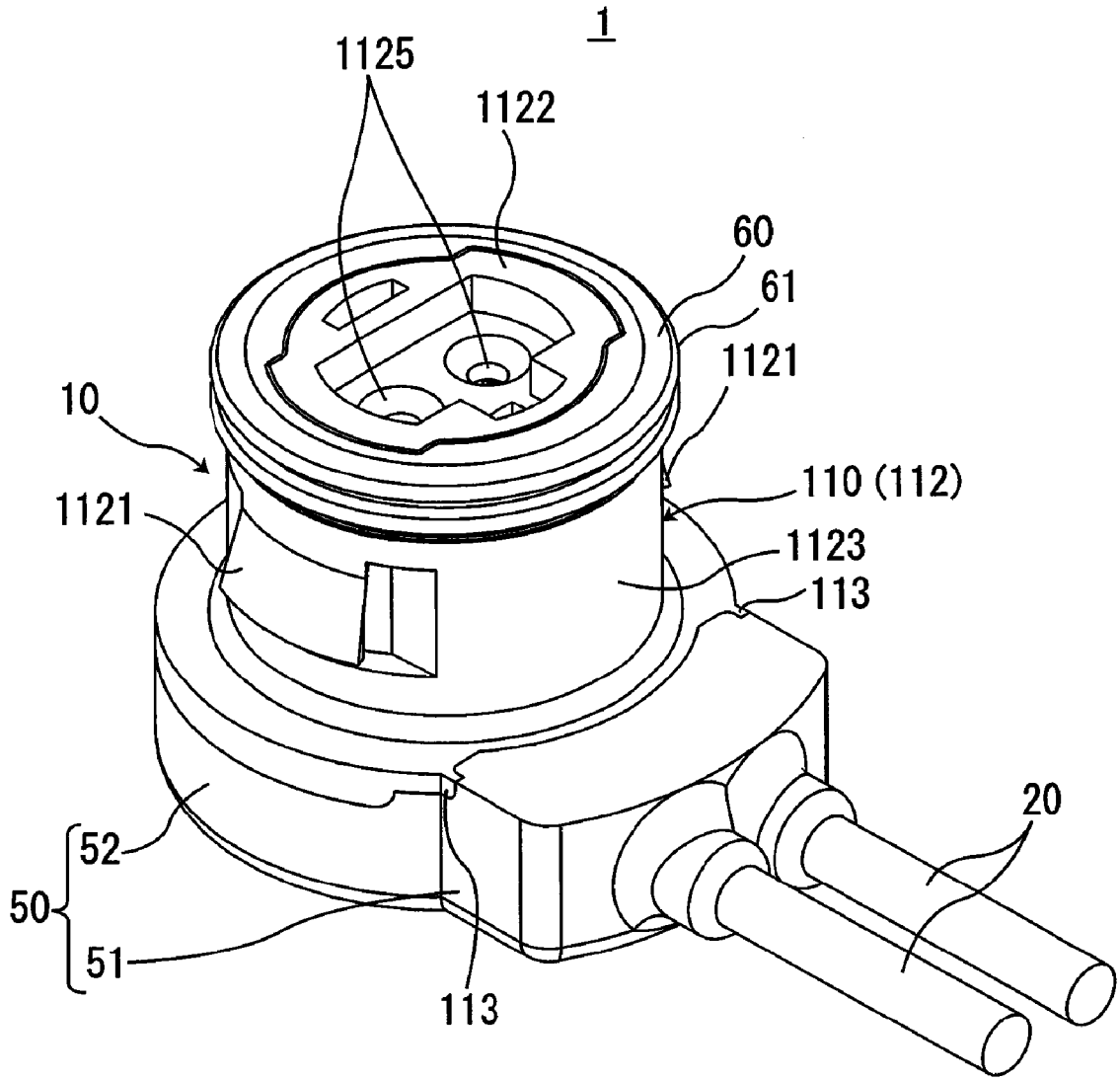
FIG. 1 is a perspective view of a squib connector viewed from a fitting face side.
Figure 2:
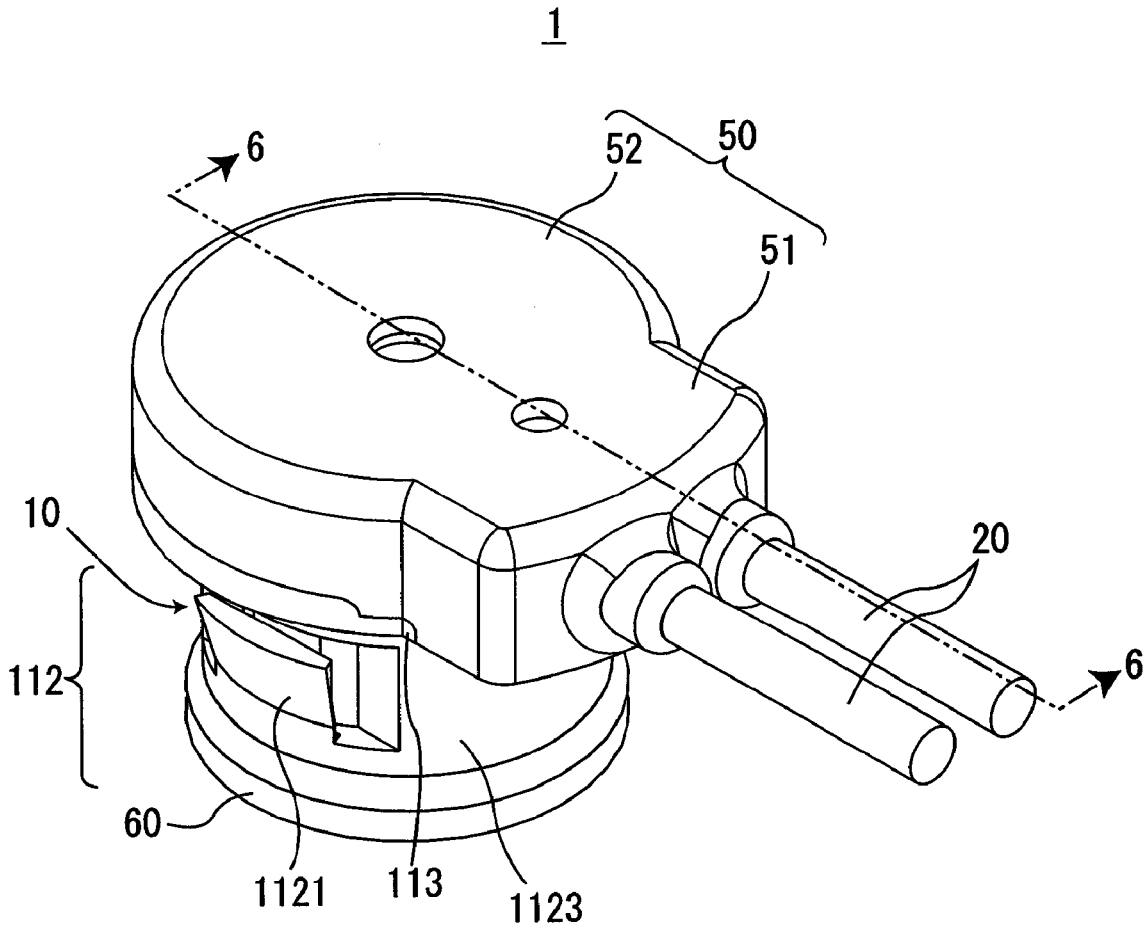
FIG. 2 is a perspective view of the squib connector viewed from a face side opposite to the fitting face.
Figure 3:
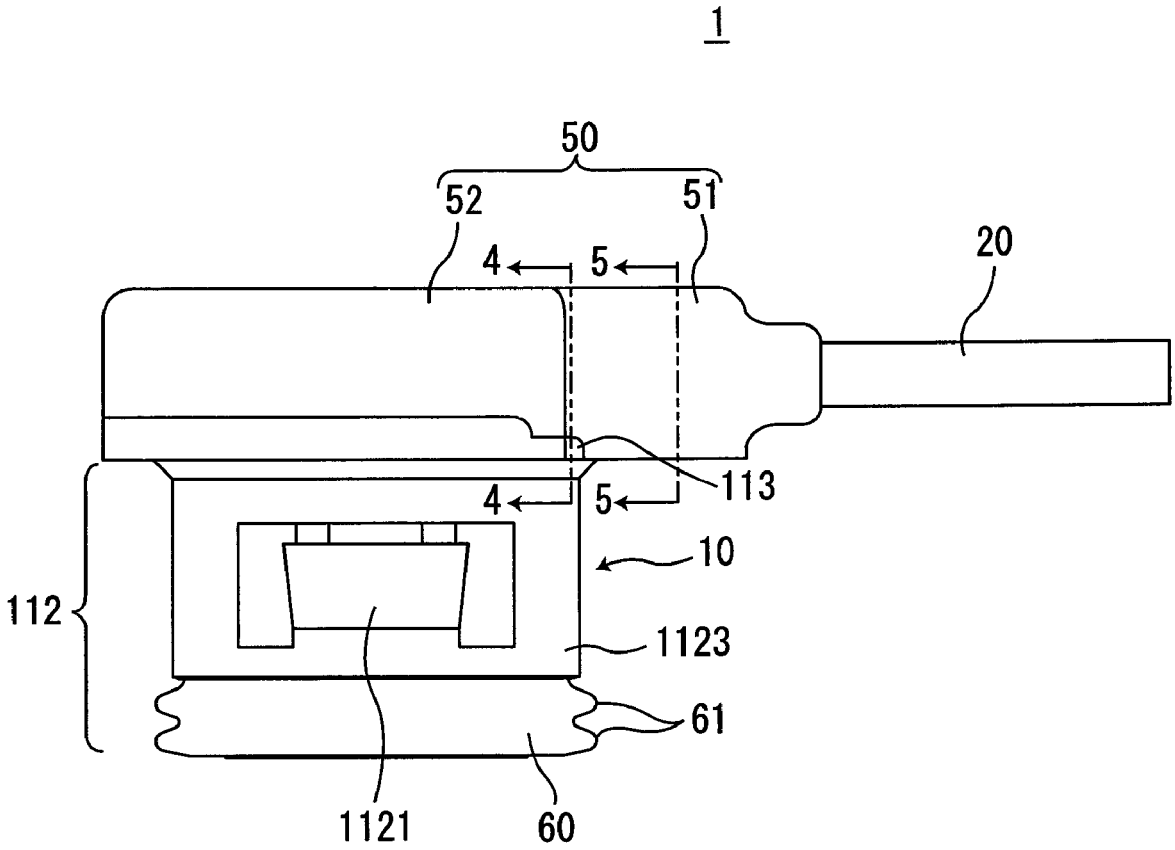
FIG. 3 is a side view of the squib connector.

FIG. 1 to 3 are views each illustrating an appearance of a squib connector 1 as one embodiment of a waterproof electrical connector of the present invention.

Figure 4:
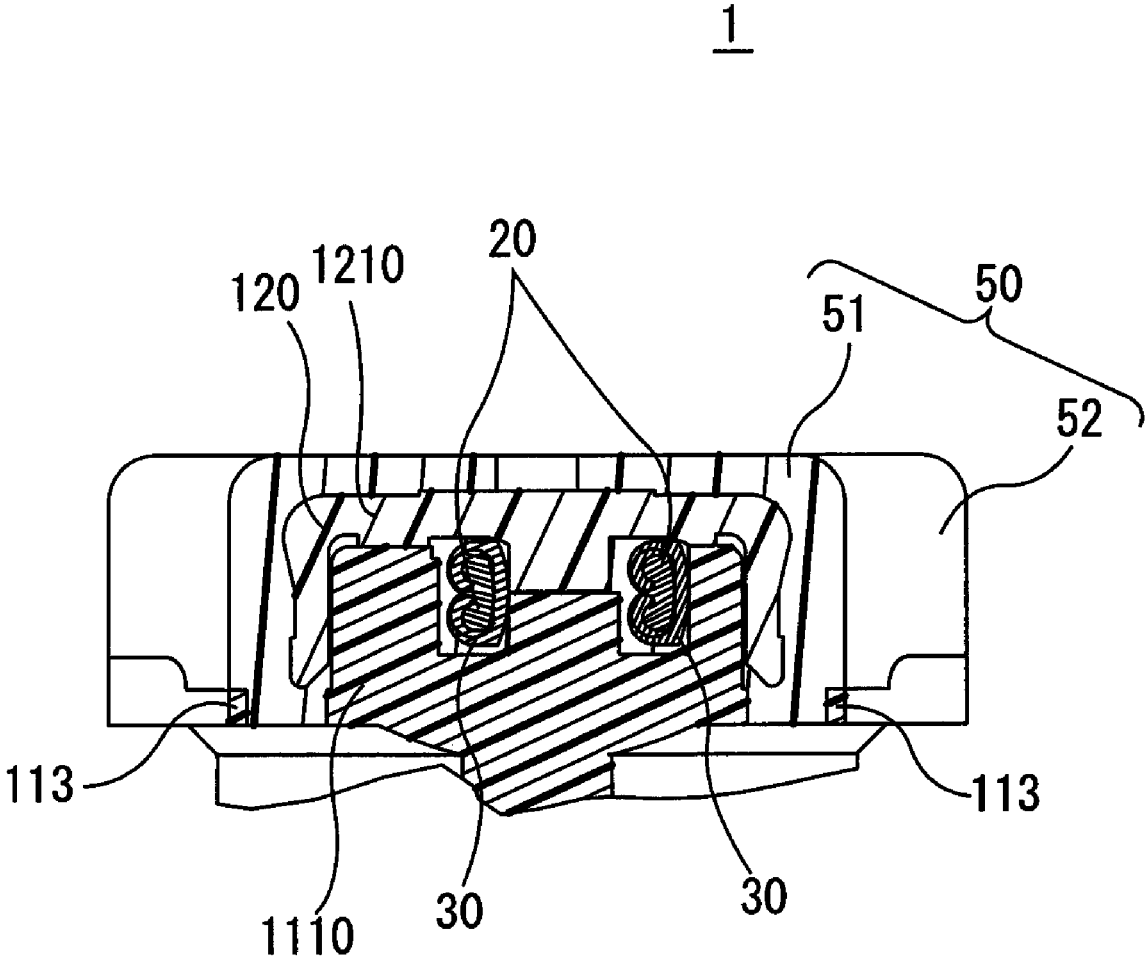
FIG. 4 is a cross-sectional view taken along a line 4-4 in FIG. 3.
Figure 5:
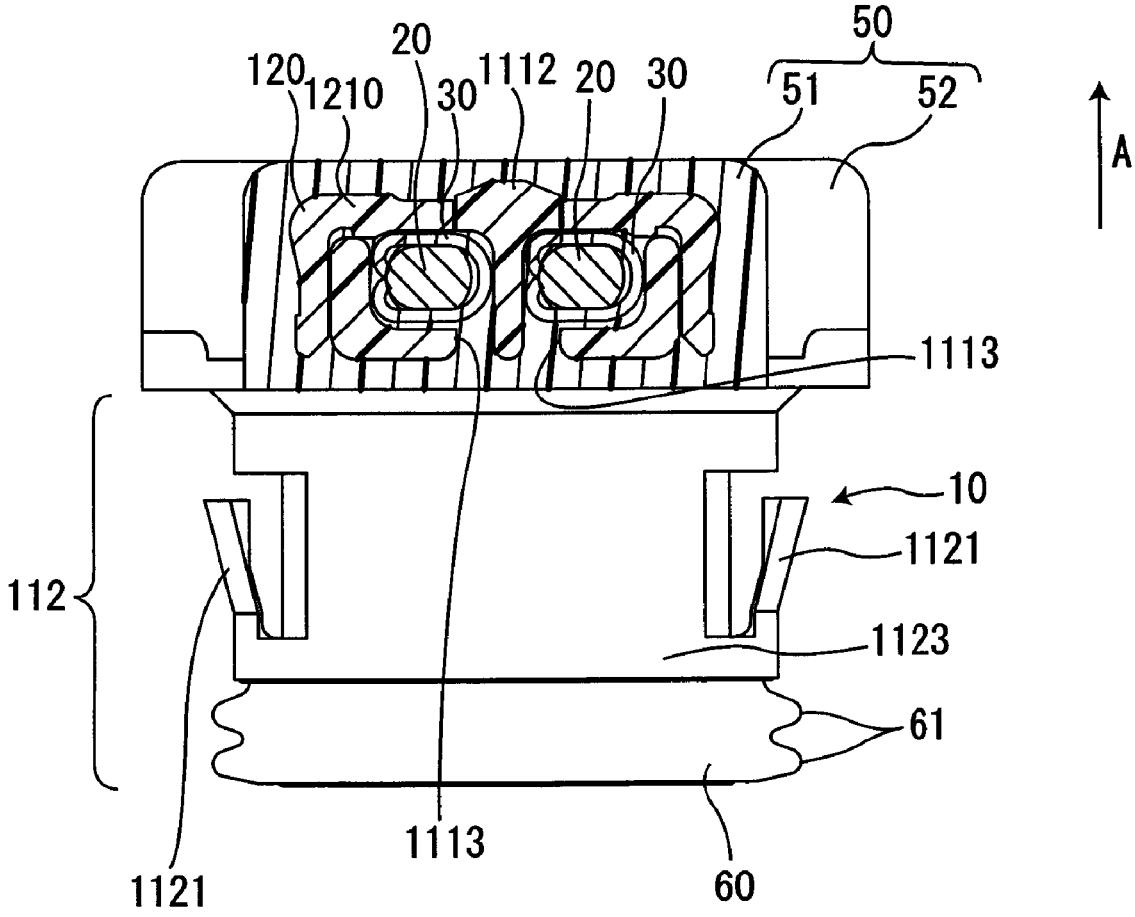
FIG. 5 is a cross-sectional view taken along a line 5-5 in FIG. 3.
Figure 6:
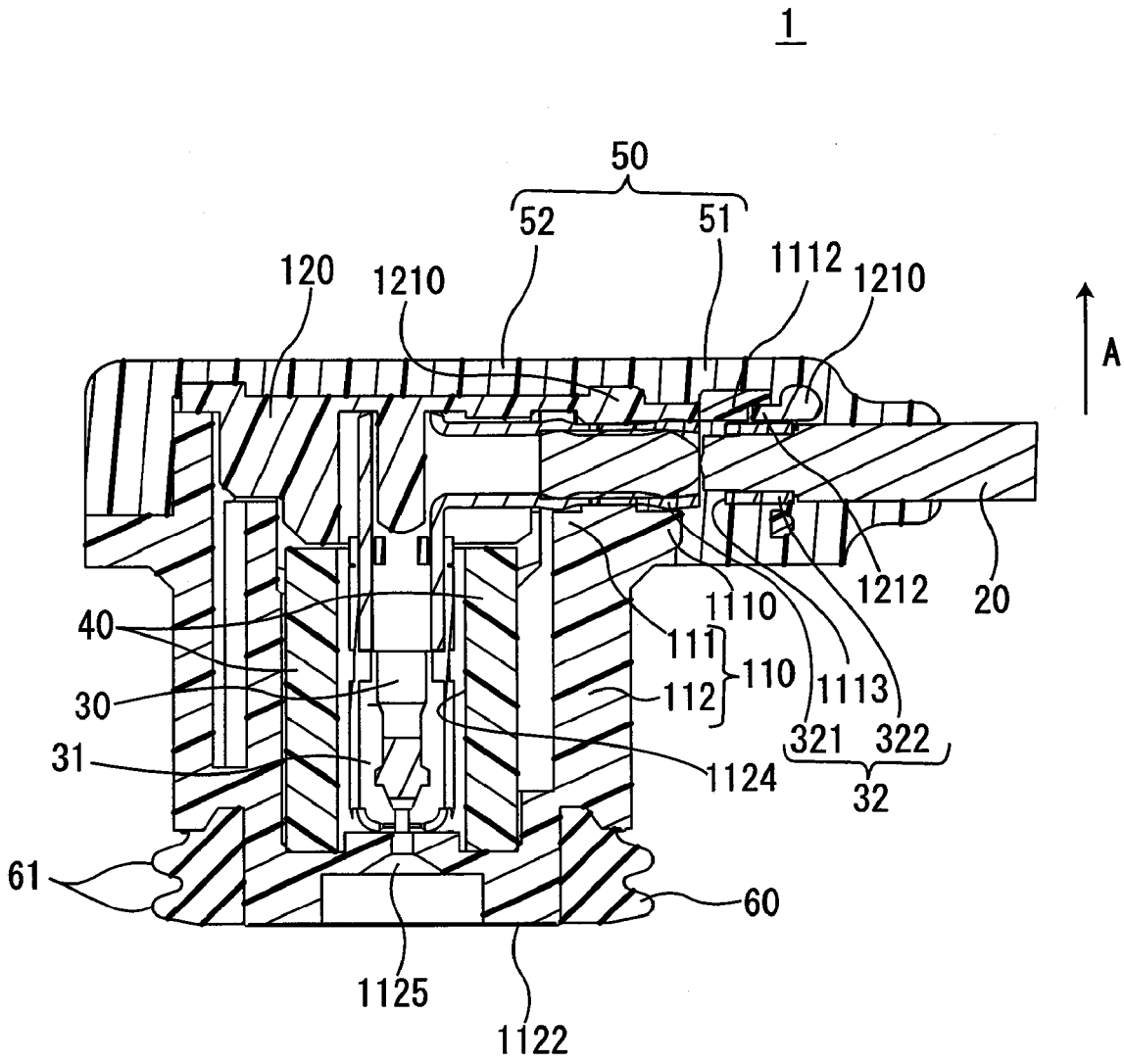
FIG. 6 is a cross-sectional view taken along a line 6-6 in FIG. 2.

FIG. 1 is a perspective view of the squib connector 1 viewed from a fitting face side, and FIG. 2 is a perspective view of the squib connector 1 viewed from a face side opposite to the fitting surface. Moreover, FIG. 3 is a side view of the squib connector 1, FIG. 4 is a cross-sectional view taken along a line 4-4 in FIG. 3, and FIG. 5 is a cross-sectional view taken along a line 5-5 in FIG. 3. Further, FIG. 6 is a cross-sectional view taken along a line 6-6 in FIG. 2. Note that, the line 6-6 in FIG. 2 is a line passing through a center of an electrical wire 20.

Figure 7:
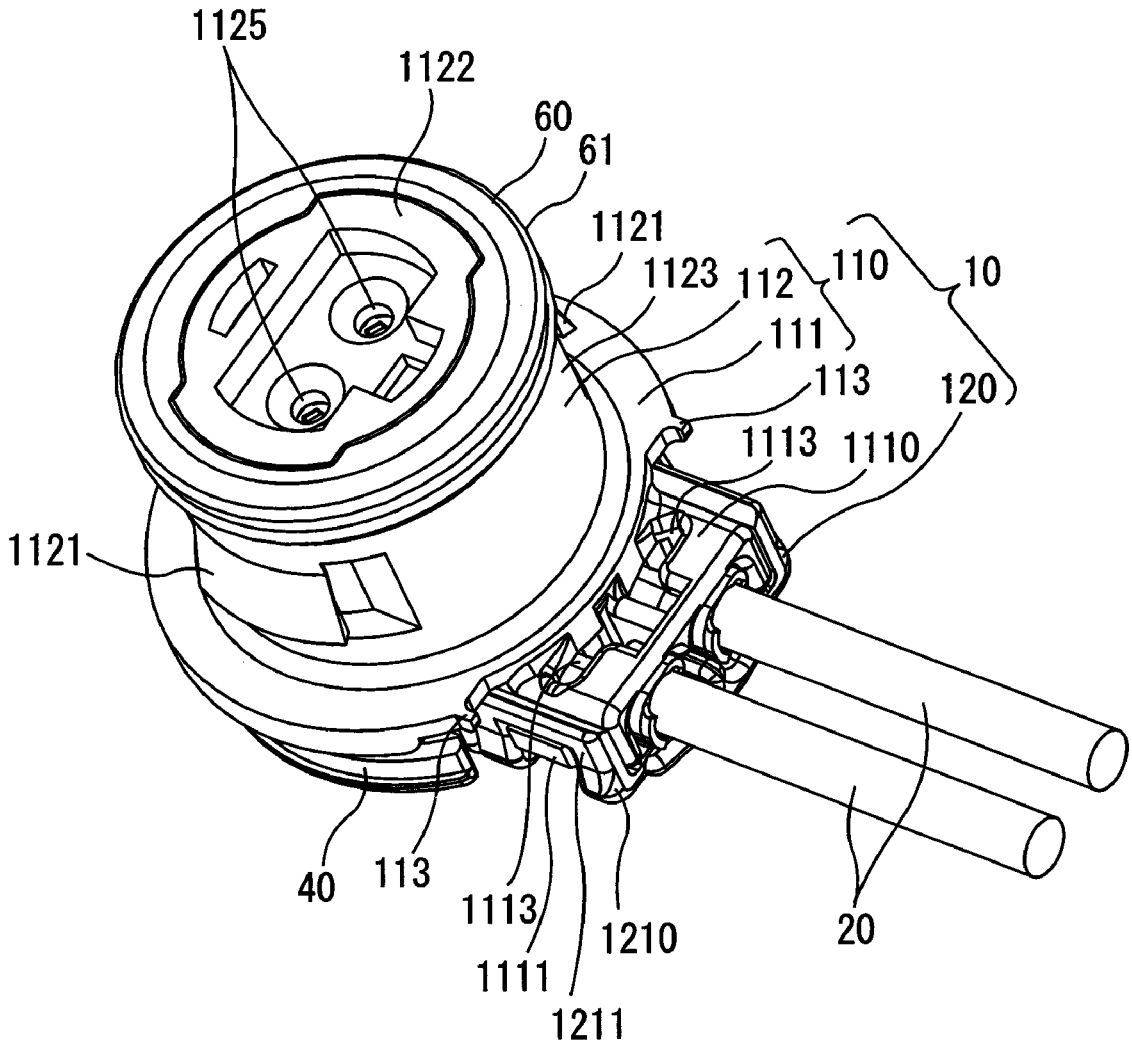
FIG. 7 is a perspective view of the squib connector illustrated in FIGS. 1 to 6 viewed from the fitting face side in a state before a body is formed on the squib connector.
Figure 8:
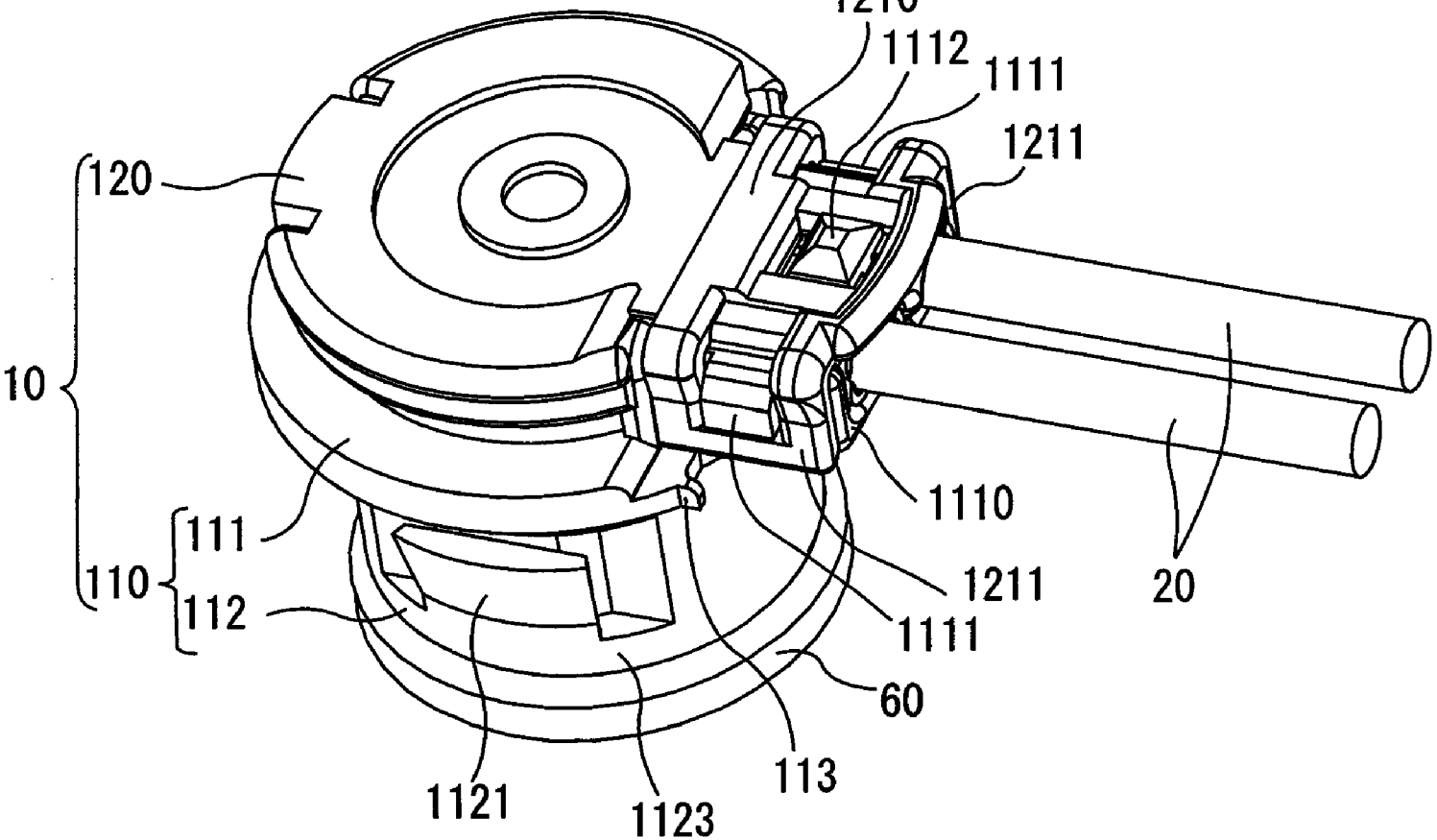
FIG. 8 is a perspective view of the squib connector viewed from the surface side opposite to the fitting face in the state.
Figure 9:
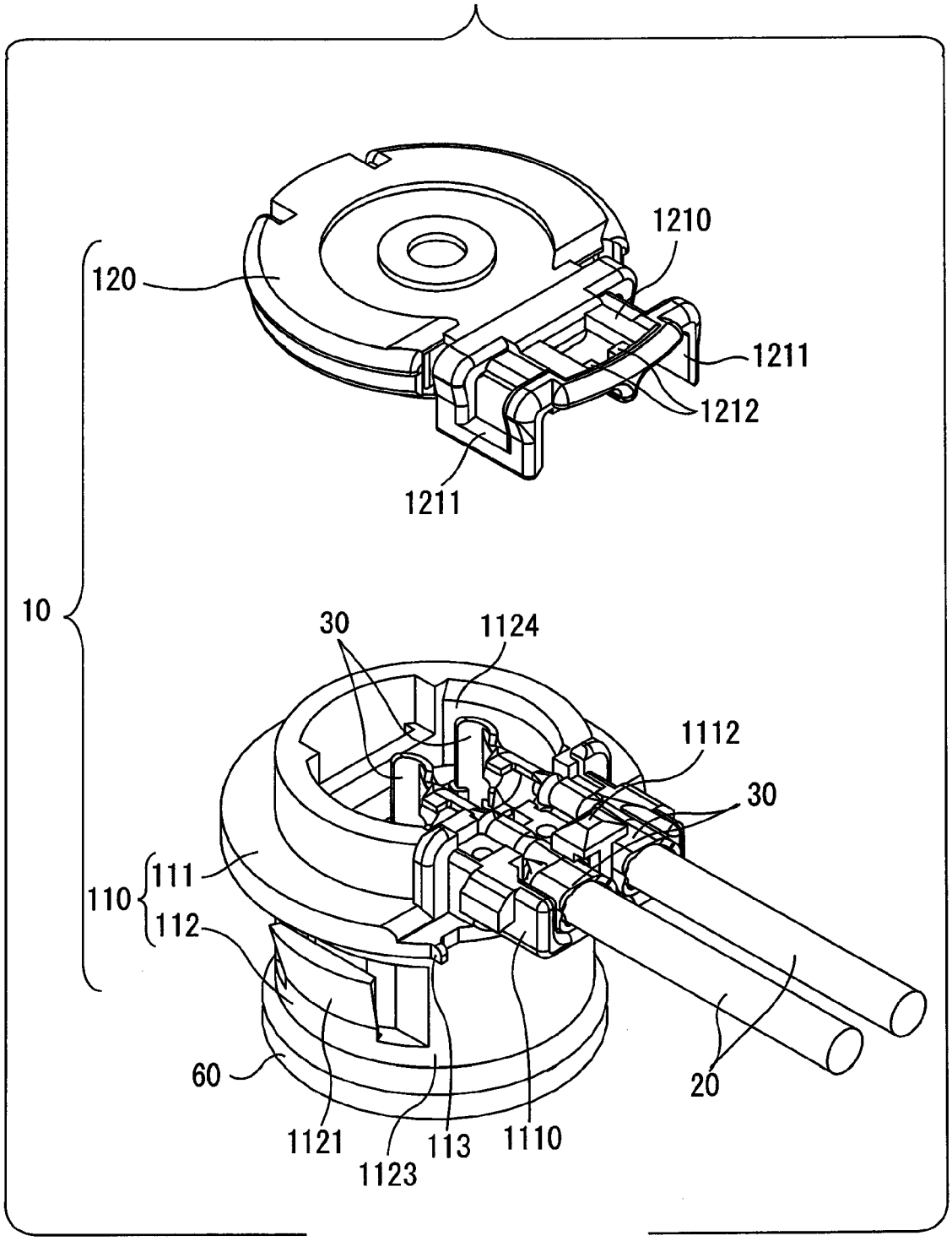
FIG. 9 is a perspective view illustrating a state in which a cover housing is detached and ferrite cores are removed from the state illustrated in FIGS. 7 and 8.
Figure 10A:
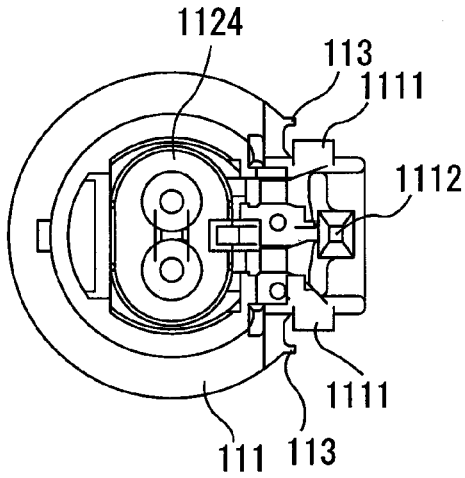
FIGS. 10A to 10E are external views of a main housing.
Figure 10D:
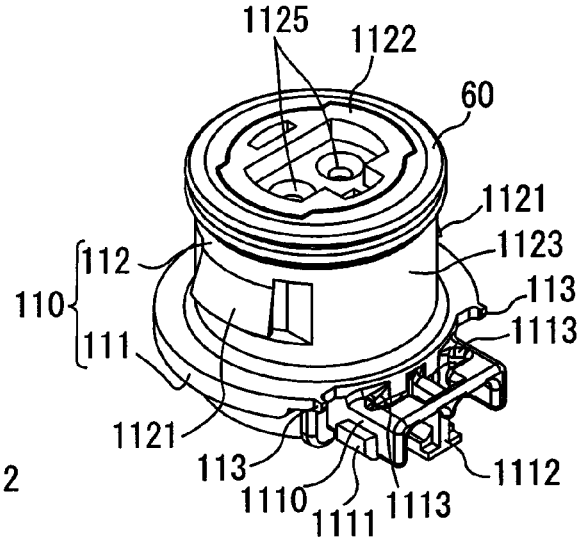
Figure 10B:
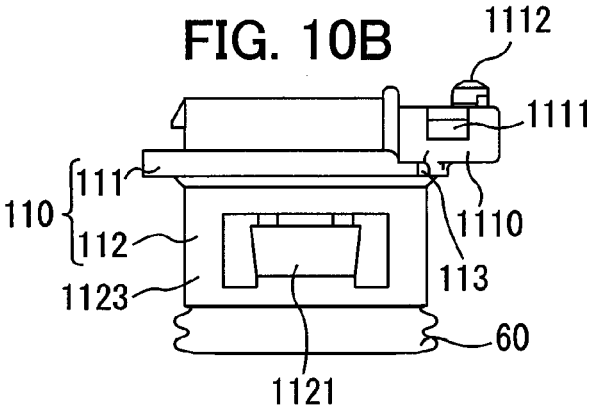
Figure 10E:
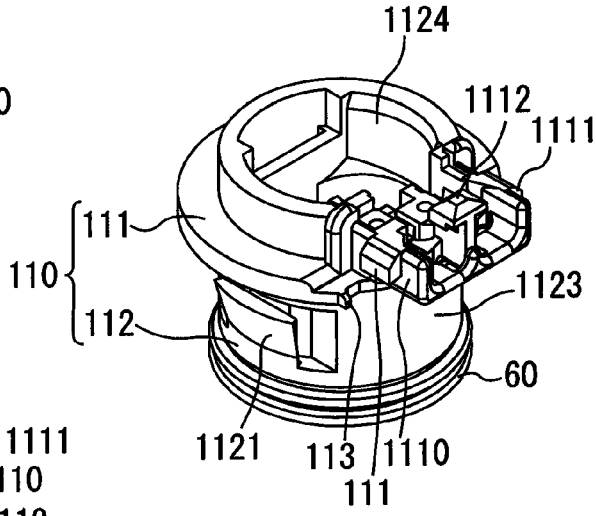
Figure 10C:
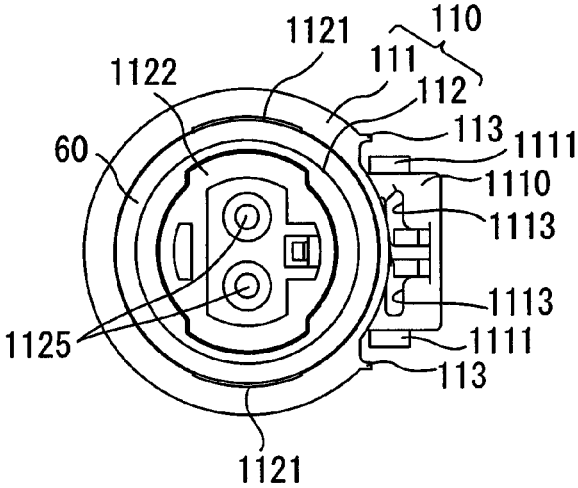

FIG. 7 is a perspective view of the squib connector 1 illustrated in FIGS. 1 to 6 viewed from the fitting face side in a state before a body 50 is formed on the squib connector 1. FIG. 8 is a perspective view of the squib connector 1 viewed from the face side opposite to the fitting face under this state. Moreover, FIG. 9 is a perspective view illustrating a state in which a cover housing 120 is detached and ferrite cores 40 are removed from the state illustrated in FIG. 7 and 8. Further, FIGS. 10A to FIG. 10E are external views of a main housing 110. Furthermore, FIG. 10A is a plane view, FIG. 10B is a side view, FIG. 10C is a rear view, FIG. 10D is a perspective view viewed from the fitting face side, and FIG. 10E is a perspective view viewed from the face side opposite to the fitting face.

The squib connector 1 connects the electrical wires 20 to a non-illustrated mating connector included in an ignition device of a vehicle airbag.

As illustrated in FIGS. 1 to 3, the squib connector 1 includes an insulative housing 10, a seal 60, and a body 50. The insulative housing 10 has a fitting section 112 that fits into a fitting recess portion of the mating connector.

As illustrated in FIG. 6, the insulative housing 10 of the squib connector 1 also has, in its interior, contacts 30 connected to one end of the insulatively coated electrical wires 20, and a ferrite core 40 for noise absorption. The contact 30 and the ferrite core 40 are housed in a contact chamber 1124 formed in the fitting section 112 of the insulative housing 10. On a top end 1122 of the fitting section 112, there is formed an aperture 1125 through which the contact chamber 1124 communicates with an outer section. When the squib connector 1 is connected to the mating connector, a male contact of the mating connector is inserted into the contact chamber 1124 through the aperture 1125, and connected to the contact 30.

A specific explanation will be next given of parts that form the squib connector 1.

As illustrated in FIG. 6, the contact 30 is a female contact that is fit into the male contact of the mating connector, and is a member which is formed by punching, bending, and plating a metal plate. Each contact 30 has an almost L-shape and includes a contact section 31 contacting with the male contact of the mating connector, and a wire connection section 32 connected to the one end of the wire 20. The wire connection section 32 has a core wire crimping section 321 which crimps a core wire of the wire 20, and an insulating coating crimping section 322 which crimps an insulating coating of the wire 20.

As illustrated in FIGS. 7 to 9, the insulative housing 10 includes a main housing 110 and a cover housing 120 which are both made of insulating synthetic resin.

As illustrated in FIGS. 6 to 10E, the main housing 110 of the insulative housing 10 has a cylindrical fitting section 112, which is fitted into a contact-receiving concavity of the mating connector, and a head section 111 of the fitting section 112, which stretches to a rear portion of the fitting section 112, the rear portion being a portion which spreads toward the rear in a direction in which the main housing 110 is fitted into a mating connector. The wire connection sections 32 are housed in the head section 111, each of the wire connection sections 32 connected to the one end of the wire 20, which is guided out in a direction perpendicular to the direction in which the main housing 110 is fitted into a mating connector. Each of the contact sections 31 of the contact 30 are housed in the fitting section 112. In addition, the head section 111 has an electrical wire housing end section 1110 projected in a direction in which the wires 20 are guided out. A projection 1111 is formed on both side surfaces of the electrical wire housing end section 1110. Further, as illustrated in FIGS. 1 to 3, a lock 1121 is formed on an outer periphery 1123 of the fitting section 112 of the main housing 110. The lock 1121 locks the fitting section 112 when the fitting section 112 is inserted into a predetermined position of the contact-receiving concavity of the mating connector, and is formed integrally with the main housing 1 10.

As illustrated in FIGS. 6 to 9, the cover housing 120 of the insulative housing 10 covers the head section 111 of the main housing 110. Moreover, the cover housing 120 has an electrical wire covering end section 1210 that covers the electrical wire housing end section 1110 of the main housing 110. The lock 1211 is provided on both ends of the electrical wire covering end section 1210. The lock 1211 prevents the cover housing 120 covering the head section 111 from coming off the head section 111.

As illustrated in FIGS. 4 to 8, the insulative housing 10 holds the electrical wire connection sections 32 of the contacts 30 and the electrical wires 20 by sandwiching them between the electrical wire housing end section 1110 of the main housing 110 and the electrical wire covering end section 1210 of the cover housing 120. In other words, the one end of each of the electrical wires 20 is housed in the electrical wire housing end section 1110, and covered with the electrical wire covering end section 1210 to be guided out from the electrical wire housing end section 11 10.

Further, the electrical wire housing end section 1110 of the main housing 110 has an electrical wire restraining member 1112. As illustrated in FIGS. 5 to 10E, the electrical wire restraining member 1112 projects from a bottom of the electrical wire housing end section 1110 to the cover housing 120 side of the one end of each of the electrical wires 20 housed in the electrical wire housing end section 1110 and spreads between one end of each of the electrical wires 20 and the electrical wire covering end section 1210 of the cover housing 120. Accordingly, even when a force lifts the electrical wires 20 to the cover housing 120 side acts on the electrical wires 20, that is, the electrical wires 20 are pulled up (in a direction of arrows A in FIGS. 5 and 6), and an upward (direction of the arrows A in FIGS. 5 and 6) force acts on the electrical wires 20, the one end of each of the electrical wires 20 in the electrical wire housing end section 1110 is restrained by the electrical wire restraining member 1112. Therefore, the one end of each of the electrical wires 20 restrained by the electrical wire restraining member 1112 in the electrical wire housing end section 1110 is prevented from being lifted. Namely, even when the force acts thereon, the force is prevented from being directly transmitted to the housing 120 to bend the cover housing 120.

Moreover, as illustrated in FIGS. 6 and 9, the electrical wire covering end section 1210 has claw members 1212 that goes into between the one end of each of the electrical wires 20 housed in the electrical wire housing end section 1110 of the main housing 110 and the electrical wire restraining member 1112. The claw members 1212 stop the cover housing 120 from coming off the head section 111 in corporation with the lock 1211, and prevents the electrical wire covering end section 1210 from being lifted when an upward (direction of the arrows A in FIGS. 5 and 6) force acts on the electrical wires 20.

Further, as illustrated in FIGS. 5 to 7 and FIGS. 10A to 10E, the electrical wire housing end section 1110 of the main housing 110 has through-holes 1113, each through hole 1113 formed at a position where the core wire crimping section 321 of the electrical wire connection section 32 becomes exposed in a state that the electrical wire connection sections 32 of the contacts 30 and the electrical wires 20 are housed in the electrical wire housing end section 1110 before the body 50 is formed. Furthermore, as illustrated in FIGS. 7 to 10E, the main housing 110 has projection walls 113, which project in a direction in which the electrical wires 20 are guided out, at boundary portions between the fitting section 112 and the head section 111. Noted that, the through-holes 1113 and the projection walls 113 will be described later together with an explanation of the body 50.

The body 50 is formed to be integral with the insulative housing 10 by melt molding. As illustrated in FIGS. 1 to 6, the body 50 covers a part of the main housing 110 and the entire surface of the cover housing 120, which includes both a boundary portion between the main housing 110 and the cover housing 120 and portions sandwiching the electrical wires 20 guided out. In other words, the insulating coatings of the electrical wires 20 adhere to the insulative housing 10 with the body 50. It is noted that, for example, polyamide-based hot melt and polyester-based hot melt are used as material of the body 50. Moreover, material of the body 50 is not limited to these, and any material may be used if it has the following characteristics. The material can be molded to be integral with the insulative housing 10 by injection molding, for instance. The material can be formed with low pressure in a short time. The material has a high affinity for resin material that forms the insulative housing 10 and does not adhere to the metal mold.

Further, as illustrated in FIGS. 5 and 6, the body 50 is flowed in from the through holes 1113 formed on the electrical wire housing end section 1110 of the main housing 110 and fills in around the one end of each of the electrical wires 20 including the core wire crimping section 321 of the electrical wire connection section 32 housed in the electrical wire housing end section 1110. In the conventional squib connector, such filling is not provided, and therefore when the body is peeled off the insulative housing, there is possibility of water entering around the one end of each of the electrical wires including the core wire crimping section of the electrical wire connection section. According to the squib connector 1 of the present embodiment, the waterprooffness of the squib connector 1 is maintained by the body 50, which is flowed in through the through-holes 1113 and fills in around the one end of each of the electrical wires 20 housed in the electrical wire housing end section 1110 by pouring the body.

Further, as illustrated in FIGS. 1 to 6, the body 50 has a first portion 51 which covers the electrical wire housing end section 1110 and the electrical wire covering end section 1210, and a second portion 52 which covers portions of the head section 111 of the main housing 110 except the electrical wire housing end section 1110 and portions of the cover housing 120 except the electrical wire covering end section 1210. Then, the projection walls 113, which project from the boundary portion between the fitting section 112 and the head section 111, is exposed on a surface of a boundary portion between the first portion 51 and the second portion 52 of the body 50. Therefore, this eliminates an edge section of the body 50 on the surface of the boundary portion between the first portion 51 and the second portion 52 of the body 50. As a result, even when an upward (direction of the arrows A in FIGS. 5 and 6) force acts on the electrical wires 20, a shearing force acts on the body 50 in the vicinity of the projection wall 113, and therefore the body 50 is prevented from separating with the insulative housing 10.

The seal 60 is integrally provided on an outer peripheral surface 1123 in the vicinity of an top end 1122 of the fitting projection portion 112. The seal 60 is formed by insert-molding, for example, silicone rubber onto the outer peripheral surface 1123 of the formed main housing 110. The silicone rubber is adhered onto the main housing 110 in an insert-molding process, and forms the seal 60 integral with the main housing 110. Note that, the seal 60 and the main housing 110 can be simultaneously formed to be integral with each other by two-color molding. The seal 60 is formed in an annular shape to surround a part of the outer peripheral surface 1123, and a lip section 61 is formed on the outermost periphery. The lip section 61 projects further outward than the outer peripheral surface 1123, and an outer diameter of the seal 60 is larger than an inner diameter of the contact-receiving concavity of the mating connector. In other words, the seal 60 is formed to elastically contact closely to the inner wall of the contact-receiving concavity when the fitting section 112 is inserted into the contact-receiving concavity.

The squib connector 1 is manufactured as follows. First, the ferrite cores 40 and the contacts 30 connected to the electrical wires 20 are housed in the contact chamber 1124 of the main housing 110. Next, the cover housing 120 is attached to the main housing 110, and the body 50 is formed outside the insulative housing 10.

In the squib connector 1, when an upward (direction of the arrows A in FIGS. 5 and 6) force acts on the electrical wires 20, the force is transmitted to the electrical wire housing end section 1110 provided with the electrical wire restraining member 1112. Further, the force is transmitted to the electrical wire covering end section 1210 which covers the electrical wire housing end section 1110 and is prevented from being lifted by the claw members 1212, through the electrical wire housing end section 1110. Accordingly, for example, in a case where the force is strong enough to lift the one end of each of the electrical wires 20 restrained by the electrical wire restraining member 1112 in the electrical wire housing end section 1110 in a state in which the fitting section 112 of the squib connector 1 is fitted into the contact-receiving concavity of the mating connector, the following result is obtained. Namely, the electrical wire housing end section 1110 and the electrical wire covering end section 1210 are lifted together toward the cover housing 120 side.

Figure 11:
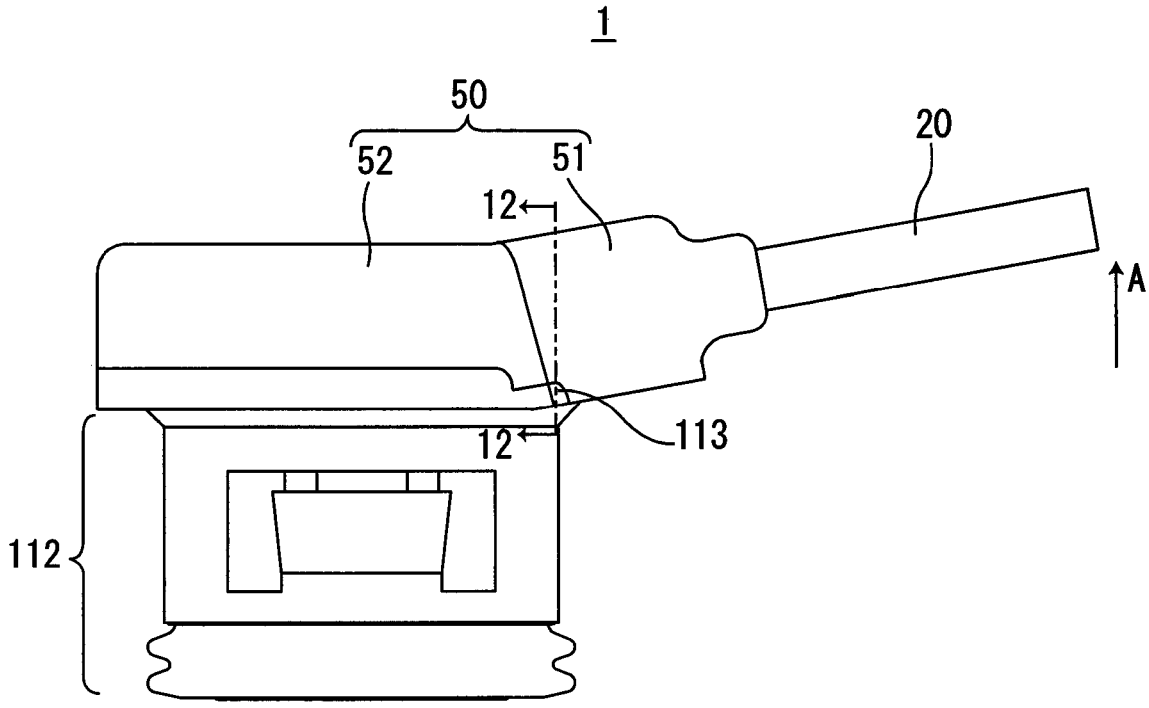
FIG. 11 is a side view of the squib connector in a state in which the electrical wire housing end section and the electrical wire covering end section are lifted together to the cover housing side.
Figure 12:
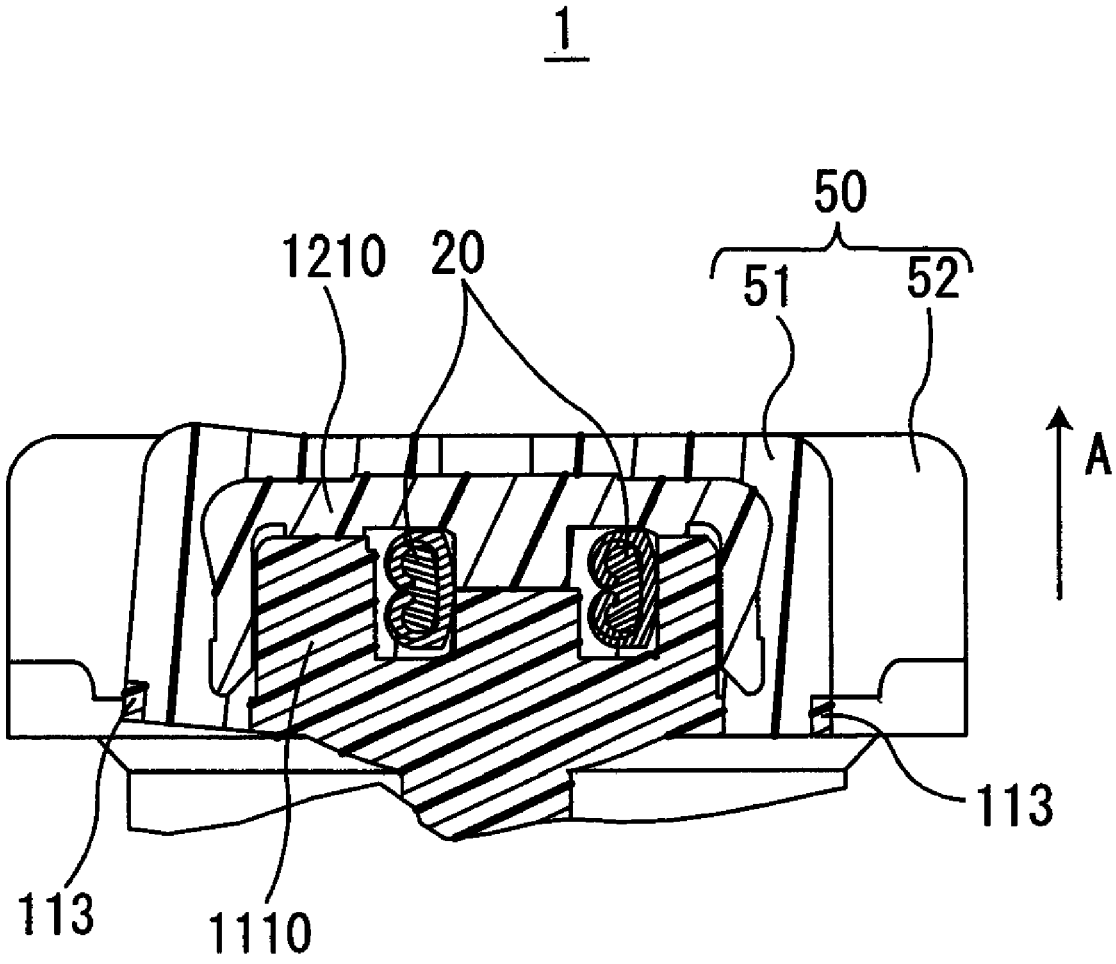
FIG. 12 is a cross-sectional view taken along a line of 12-12 in FIG. 11.

FIG. 11 is a side view of the squib connector 1 when the electrical wire housing end section 1110 and the electrical wire covering end section 1210 are lifted together toward the cover housing 120 side. FIG. 12 is a cross-sectional view taken along a line 12-12 in FIG. 11.

For example, in a case where an upward (direction of arrows A in FIGS. 11 and 12) force acting on the electrical wires 20 is strong enough to lift the one end of each of the electrical wires 20 restrained by the electrical wire restraining member 1112 in the electrical wire housing end section 1110 (see FIGS. 6, 8 to 10E) in a state in which the fitting section 112 of the squib connector 1 is fit into the contact-receiving concavity of the mating connector, the following result is obtained. Namely, the body 50, which covers a boundary portion between the electrical wire housing end section 1110 and the electrical wire covering end section 1210, is in a stationary state relative to both the electrical wire housing end section 1110 and the electrical wire covering end section 1210, which are lifted together upwardly (direction of the arrows A in FIGS. 11 and 12). Therefore, even in such a case, the body is hardly peeled.

As explained above, according to the squib connector 1 of the present embodiment, the one end of each of the electrical wires 20 is prevented from being lifted without being increased in size, and the body 50 is hardly peeled off the insulative housing 10. Accordingly, the squib connector 1 of the present embodiment has a high waterprooffness without preventing a reduction in height and without increasing its size.

In addition, in the present embodiment, an example in which the waterproof electrical connector of the present invention is the squib connector has been described. However, the present invention is not limited to this and can be applied to a waterproof electrical connector used for other purposes. The waterproof electrical connector of the present invention can be used at a location where condensation easily occurs. Therefore, when the waterproof electrical connector according to the present invention is applied to the squib connector connected to an ignition device of a vehicle airbag, this can be used as a squib connector for a curtain airbag or side airbag installed inside a vehicle door.

Moreover, in the present embodiment, an example in which the electrical wire housing section of the main housing has a through-hole has been described. However, the present invention is not limited to this and a through-hole may be provided to the electrical wire housing section and/or electrical wire covering end section. Note that, when the through-hole is formed on the electrical wire covering end section of the cover housing, strength of the electrical wire covering end section is reduced, and therefore the through-hole is preferably formed on the electrical wire housing end section of the main housing.

What is claimed is:

1. A waterproof electrical connector comprising:

a main housing including:

a fitting section which is fitted into a contact-receiving concavity of a mating connector; and a head section extending at a rear of the fitting section in a direction in which the fitting section is fitted into the mating connector;

a contact that is housed in the fitting section such that one end of the contact is housed in the head section and is connected to one end of an insulated electrical wire which is guided out in a direction perpendicular to the direction in which the fitting section is fitted into the mating connector;

a cover housing that covers the head section; and a body that covers at least a boundary portion between the main housing and the cover housing, wherein the head section includes an electrical wire housing end section which projects in the direction in which the electrical wire is guided out, the cover housing includes an electrical wire covering end section which covers the electrical wire housing end section, the one end of the electrical wire is housed in the electrical wire housing end section and covered by the electrical wire covering end section, the electrical wire is guided out from the electrical wire housing end section, and the electrical wire housing end section includes an electrical wire restraining member that projects from a bottom of the electrical wire housing end section to a side of the cover housing with respect to the one end of the electrical wire housed in the electric wire end housing section and extends between the one end of the electrical wire and the electrical wire covering end section, and restrains the one end of the electrical wire in the electrical wire housing end section so as to prevent the one end of the electrical wire from being lifted when a force lifting the electrical wire to a side of the cover housing acts on the electrical wire.

2. The waterproof electrical connector according to claim 1, wherein the electrical wire covering end section includes a claw section that goes into between the one end of the electrical wire housed in the electrical wire housing end section and the electrical wire restraining member.

3. The waterproof electrical connector according to claim 2, wherein the claw section prevents the electrical wire covering end section from being lifted when a force lifting the electrical wire to a side of the cover housing acts on the electrical wire.

4. The waterproof electrical connector according to claim 1, wherein the electrical wire housing end section and the electrical wire covering end section includes a through hole.

5. The waterproof electrical connector according to claim 4, wherein the body covers a boundary portion between the main housing and the cover housing, and is formed by being flowed in through the through hole so as to fill in around the one end of the electrical wire housed in the electrical wire housing end section by being poured through the through hole.

6. The waterproof electrical connector according to claim 1, wherein the electrical wire covering end section includes a through hole.

7. The waterproof electrical connector according to claim 6, wherein the body covers a boundary portion between the main housing and the cover housing, and is formed by being flowed in through the through hole so as to fill in around the one end of the electrical wire housed in the electrical wire housing end section by being poured through the through hole.

8. The waterproof electrical connector according to claim 1, wherein the electrical wire housing end section and the electrical wire covering end section includes a through hole.

9. The waterproof electrical connector according to claim 8, wherein the body covers a boundary portion between the main housing and the cover housing, and is formed by being flowed in through the through hole so as to fill in around the one end of the electrical wire housed in the electrical wire housing end section by being poured through the through hole.

10. The waterproof electrical connector according to claim 1, wherein the body has a first section which covers the electrical wire housing end section and the electrical wire covering end section, and a second section which covers a portion except the electrical wire housing end section of the head section and a portion except the electrical wire covering end section of the cover housing.

11. The waterproof electrical connector according to claim 10, wherein the main housing has a projection wall that projects from a boundary portion between the fitting section and the head section in a direction in which the electrical wire is guided, and that is exposed on a surface of a boundary portion between the first section and the second section of the body.

12. The waterproof electrical connector according to claim 1, wherein the waterproof electrical connector is a squib connector for connecting the electrical wire to an ignition device of a vehicle airbag.

* * * * *